US012600514B2

(12) United States Patent
Krauß et al.

(10) Patent No.: US 12,600,514 B2
(45) Date of Patent: Apr. 14, 2026

(54) NEST REMOVER AND STERILE CHAMBER

(71) Applicant: Syntegon Technology GmbH, Waiblingen (DE)

(72) Inventors: Ulrich Krauß, Ilshofen (DE); Stefan Nagler, Unterschneidheim (DE); Patrick Holl, Crailsheim (DE); Markus Ilgenfritz, Feuchtwangen (DE)

(73) Assignee: Syntegon Technology GmbH, Waibilingen (DE)

( * ) Notice: Subject to any disclaimer, the term of this patent is extended or adjusted under 35 U.S.C. 154(b) by 271 days.

(21) Appl. No.: 18/030,212

(22) PCT Filed: Sep. 27, 2021

(86) PCT No.: PCT/EP2021/076449
§ 371 (c)(1),
(2) Date: Apr. 4, 2023

(87) PCT Pub. No.: WO2022/073780
PCT Pub. Date: Apr. 14, 2022

(65) Prior Publication Data

US 2023/0348127 A1 Nov. 2, 2023

(30) Foreign Application Priority Data

Oct. 9, 2020 (DE) ..... 10 2020 126 552.2

(51) Int. Cl.
*B65B 43/46* (2006.01)
*B65B 61/20* (2006.01)

(52) U.S. Cl.
CPC ..... *B65B 43/46* (2013.01); *B65B 61/207* (2013.01)

(58) Field of Classification Search
CPC ..... B65B 43/46; B65B 43/54; B65B 61/207
See application file for complete search history.

(56) References Cited

U.S. PATENT DOCUMENTS

2011/0306053 A1 12/2011 Ochsenbein et al.
2012/0090268 A1* 4/2012 Krauss ..... B65B 3/003 53/281
2014/0027332 A1 1/2014 Pawlowski et al.
2018/0071168 A1* 3/2018 Naing ..... B65B 57/02
2018/0214880 A1 8/2018 Ketner
2018/0229866 A1 8/2018 Eberhardt et al.
2018/0339796 A1* 11/2018 Bai ..... B65B 65/003
(Continued)

FOREIGN PATENT DOCUMENTS

CN 101033040 A 9/2007
CN 207712785 U 8/2018
CN 110422625 A 11/2019
(Continued)

OTHER PUBLICATIONS

German Patent Office Action for Related Application No. 102020126552.2 dated May 21, 2021 (5 pages, including an English statement of relevance).
(Continued)

*Primary Examiner* — Saul Rodriguez
*Assistant Examiner* — Brendan P Tighe
(74) *Attorney, Agent, or Firm* — Michael Best & Friedrich LLP

(57) ABSTRACT

The invention relates to an apparatus for removing a nest from a tub without using vacuum.

15 Claims, 6 Drawing Sheets

(56) References Cited

U.S. PATENT DOCUMENTS

| | | | | |
|---|---|---|---|---|
| 2021/0253279 | A1* | 8/2021 | Anatrini | B65G 47/90 |
| 2021/0253367 | A1* | 8/2021 | Anatrini | B65B 43/46 |

FOREIGN PATENT DOCUMENTS

| | | | | | |
|---|---|---|---|---|---|
| CN | 111201007 | A | | 5/2020 | |
| CN | 111547498 | A | * | 8/2020 | B65G 47/90 |
| CN | 211544099 | U | | 9/2020 | |
| DE | 8809713 | U1 | | 9/1988 | |
| DE | 102014214697 | A1 | | 1/2016 | |
| DE | 202013012689 | U1 | | 7/2018 | |
| EP | 0233559 | A1 | | 8/1987 | |
| EP | 0947427 | A2 | | 10/1999 | |
| JP | S59219192 | A | | 12/1984 | |
| JP | H03178792 | A | | 8/1991 | |
| JP | H091489 | A | | 1/1997 | |
| JP | 6379864 | B2 | | 8/2018 | |
| WO | 2019071339 | A1 | | 4/2019 | |
| WO | 2019243941 | A1 | | 12/2019 | |
| WO | 2019243975 | A1 | | 12/2019 | |

OTHER PUBLICATIONS

International Search Report and Written Opinion for Related Application No. PCT/EP2021/076449 dated Dec. 20, 2021 (16 pages, including an English translation of the ISR).

Chinese Patent Office Action for Application No. 202180068576 dated Jul. 22, 2025 (14 pages including English machine translation).

* cited by examiner

Detail x

NEST REMOVER AND STERILE CHAMBER

BACKGROUND

The invention relates to an apparatus for removing a nest from a tub without using vacuum.

A nest in the present sense is a plastic carrier plate. Such a plastic carrier plate typically serves to hold primary packaging such as vials or similar containers—in particular, for medical active ingredients. Such a nest is typically handled in a plastic trough, referred to as a tub. During removal from a sterile environment, the tub can be provided with an attached cover film so that the nest and the primary packaging are situated in a closed space.

Typically, the tub and nest are handled in an automated manner in a sterile environment. The removal of the nest from the tub constitutes a demanding handling step, since the nest is arranged low inside the tub, so that, for example, a gripper must plunge into the tub in order to remove the nest. Conventionally, the nest is therefore suctioned by means of a vacuum unit and held thereon by the vacuum. However, such a vacuum unit is complicated to operate, and is particularly difficult to clean.

The nest removers which are used therefore grab the nest by suction with the aid of a vacuum when the nest is removed from the tub. For this purpose, spacer sleeves with suction devices and centering pins are attached to a suction frame in which vacuum channels are created by deep-hole drilling. The suction devices suction onto a smooth surface of the nest and thus exert the required holding force, such that the nest can be removed from the tub.

Existing nest removers using vacuum have several disadvantages, which are problematic in particular for processing toxic/highly potent active ingredients. After the machine has been set up, it is generally necessary to ensure, by means of a special decontamination cycle using H2O2, that the H2O2 also flows through the vacuum channels and thus decontaminates them. Since each nest remover has several suction devices (frequently, 10 devices), it is difficult to ensure that a sufficient amount of H2O2 passes through all suction devices.

In the case of toxic and highly potent active substances, a filter must additionally be provided, which prevents toxic aerosols of the fill material from reaching the exterior from the interior of the isolator through the vacuum. In the case of toxic and highly potent active ingredients, disarming the machine also presents a challenge, since the vacuum lines are potentially contaminated with toxic fill material up to the filter, and they cannot be reached by the water during the wash-down and diluted to a harmless concentration. As such, the entire component must either be packaged manually by the operator via the gloves into a sealed bag, and cleaned separately later, or be automatically discharged, e.g., by a robot, via an RTP Port with a docked container.

SUMMARY

The object of the invention is to provide a possibility of moving a nest out of a tub in a sterile environment, providing simple operability and, in particular, an option for cleaning.

Accordingly, an apparatus for removing a nest from a tub without using vacuum is provided according to the invention. The apparatus comprises a support structure, and in particular a frame-like support structure.

The apparatus further comprises at least two pick-up units. The pick-up units are in particular in the form of a pin. The pick-up units extend away from the support structure. In the normal orientation of the apparatus, they typically extend downwards in the vertical direction.

It is now provided that the pick-up units be arranged on the support structure in such a manner that they can be arranged on opposite sides of a substantially rectangular nest to be removed. The nest can thus be placed between the pick-up units. The pick-up units are arranged in such a way that contact portions thereof contact the nest when the nest is in a state in which it is arranged between them.

The respective contact portions of a pick-up unit have a first, horizontally-extending contact surface and a second, vertically-extending contact surface. The first, horizontally-extending contact surface serves to contact the nest from below. The second, vertically-extending contact surface serves to contact the nest from the lateral direction.

The apparatus is designed in such a way that the contact portions can be moved away from each other and/or towards each other. For this purpose, by inserting a nest between the contact portions, for example, the contact portions can be spread apart; that is to say, they can be moved away from each other. For this purpose, the pick-up units can be designed in a special manner, e.g., to be resiliently deformable, or they can be pivotably mounted in a pivotable manner; or, it is likewise possible to design the pick-up units to be rigid, and to arrange them in a manner on the support structure that allows for translatory or rotational movement. The movement can be achieved, for example, by means of a drive.

According to the invention, at least one of the pick-up units (in particular, both) comprises a resilient material, and the contact portion of the pick-up unit can be moved away from the contact portion of the other pick-up unit by bending the pick-up unit.

For example, a shaft portion of the pick-up unit can be formed from an elastic material—for example, an elastic plastic material. A pick-up unit (also both) can also be formed from an elastic material—for example, an elastic plastic material. In this case, an elastic material means a material that can deform elastically resiliently in a macroscopic dimension, e.g., because a nest which is made of a plastic material, for example, is moved between the two pick-up units. The pick-up units can hold the nest by clamping, due to the resilience of the elastic material.

An elastic material thus means a material which allows deformation (bending) of the pick-up unit without the need for high forces, such as, for example, would be the case with a steel pin. Rather, it should be possible to push a nest, which is usually made of a plastic material, between the pick-up units, and to thereby spread it apart so that it contacts the nest by clamping it.

For this purpose, the nest in the tub can be lifted from below in the direction of the support structure, or the support structure can be lowered onto the nest. Both movements can also be superimposed in order to carry out the removal process in the sense of the invention.

At least one of the pick-up units can comprise a contact portion with a centering portion. The centering portion comprises an end, facing away from the support structure, of the pick-up unit. The centering portion tapers towards the end of the pick-up unit. As a result, the nest can be moved upwards from below against the pick-up units. The centering portions widen proceeding from a lower end, such that the nest is centered between the pick-up units when it is lifted. In particular, it is provided that the nest have recesses in its outer edge which are provided for receiving the pick-up units or the centering portions thereof. The centering portion can in particular be in the form of a portion of a cone. The centering portion can transition into the first, horizontally-extending contact surface. A portion with a constant diameter and/or constant width can also be provided between the downwardly-tapering part of the centering portion and the first, horizontally-extending contact surface.

At least one of the pick-up units can be arranged movably on the support structure. The pick-up unit can be movable translationally, and can also be rotatable about the axis of its longitudinal extension, i.e., the vertical. As a result, the pick-up unit can be moved into contact with the nest by a movement towards the other pick-up unit. During rotation, it is possible for the pick-up unit or its contact portion to be pivoted into contact with the nest. For this purpose, the contact portion can in particular be formed asymmetrically with respect to the axis of the longitudinal extension. The pick-up unit or both pick-up units can also be attached to the support structure in a rigid manner which allows pivoting via a joint.

The apparatus can comprise at least one, and in particular two, vertical fixing units, which is/are particularly designed in the manner of pins. The vertical fixing unit comprises a fixing contact portion which is designed to contact the nest, which is to be gripped, from a side opposite the first, horizontally-extending contact surface of the contact portion.

When in the held state, the nest is contacted in the vertical direction from above by the fixing contact portion, and from below by the first, horizontally-extending contact surface. The nest is accordingly held in the vertical direction between the first, horizontally-extending contact surface and the fixing contact portion.

The vertical fixing unit can be designed to be able to shorten in a resilient manner along its extension in the vertical direction—in particular, via a spring mechanism which in particular comprises a spring stroke limiter.

The vertical fixing unit or at least its fixing contact portion can be movable in the vertical direction relative to the support structure. For example, a movement of the fixing contact portion via the spring mechanism is possible. However, the vertical fixing unit can also be shortened in another way. For example, it can be designed to be extendable via a telescopic mechanism, such that the fixing contact portion is movable relative to the support structure.

The vertical fixing unit and/or the pick-up unit can be designed to be removable from the support structure. This simplifies cleaning. For example, it is possible for the vertical fixing unit and/or the pick-up unit to have a fastening flange. The vertical fixing unit and/or the pick-up unit can be attached to the support structure via a screw connection, for example. The vertical fixing units can comprise an adhesive element, e.g., a suction cup, on their fixing contact portions. It is also possible for the vertical fixing units to have a hook-like end, such that they can contact the edge of a nest from above and below, wherein the fixing contact portion forms the upper contact surface in this case.

The apparatus may comprise a positioning unit designed to move a nest located in a tub towards the pick-up units. The nest is in this case accommodated in the tub.

The movement towards the pick-up units takes place in such a way that the nest is contacted from at least two opposite sides by the pick-up units and is held between them. In particular, the positioning unit can be designed to grip and move the tub. It can also be designed to remove the nest from the pick-up units and to manipulate it further after the tub has been set down.

The apparatus can comprise a nest, wherein the pick-up units are arranged on the support structure in such a manner that the nest can be arranged between them—in particular, wherein the nest has recesses in its outer edge which are provided for receiving the pick-up units and/or the centering portions and contact portions thereof. In particular, an imaginary connecting line VL of at least two of the recesses extends through a center of gravity of the nest, or, in the state in which the nest is held by the pick-up units, an imaginary connecting line VL of at least two of the pick-up units extends through a center of gravity of the nest.

In particular, an imaginary connecting line VL of at least two of the vertical fixing units or the fixing contact portion thereof runs through a center of gravity of the nest, or in the state in which the nest is held by the pick-up units.

In particular, the apparatus comprises exactly two pick-up units and/or vertical fixing units.

The nest can in particular be rectangular. The nest can in particular be formed with a circumferential, horizontally-extending edge.

The pick-up units can be arranged on the support structure such that the nest can be arranged between the pick-up units in such a way that they contact the rectangular nest on diagonally-opposite quadrants—in particular, in each case on a narrow side of the rectangular nest.

The pick-up units or recesses of the nest can also be positioned on the longitudinal sides of the nest. In this case too, they can be arranged such that they contact the rectangular nest on diagonally-opposite quadrants.

Regardless of whether the recesses of the nest and/or the engagement points of the pick-up units are arranged on the longitudinal sides or the narrow sides, they can also be arranged directly opposite each other, instead of on diagonally-opposite quadrants. In this case, they are in adjacent quadrants.

In this case, the statements regarding the positions in which the nest can be arranged refer to the intended position of the nest in which it is held by the pick-up units.

The present invention allows removal of the nest from the tub without the use of vacuum or negative pressure.

The apparatus for removing a nest from a tub without using vacuum can in particular comprise two, pin-like, pick-up units which extend away from the support structure and are formed from a flexibly bendable material. Furthermore, it can comprise two vertical fixing units which are designed to be resiliently shortened in their longitudinal extension, and which likewise extend away from the support structure in the manner of pins. Wherein the pick-up units are designed to engage in the recesses in the edge, on opposite sides of the nest, and the vertical fixing units are designed and arranged for contacting the edge, on the sides offset by 90° from the sides just mentioned. Wherein the edge of the nest when the nest is in the held state is held clamped in the vertical direction between the first, horizontally-extending contact surface and the fixing contact portion of the vertical fixing units. The second, vertically-extending contact surface forms a stop in the horizontal direction, so that the nest is fixed in the horizontal plane between the pick-up units.

In the held state, the nest is essentially held by a combination of clamping and engagement.

The shape and position of the pick-up units can be adapted according to the format, or according to the tub and nest types.

When the nest is removed from the tub, the tub together with the nest is positioned, in the first step, under the frame, e.g., by a robot, such that the centering pins are positioned over the recesses in the edge of the nest. Subsequently, the tub is lifted together with the nest. Conversely, it is also conceivable that the tub with the nest be set down, and the support structure with the pick-up units and vertical fixing units arranged thereon be lowered onto the nest in order to grip the nest.

The centering portions of the pick-up units initially center the nest and align it. The pick-up units are then easily spread open by the nest, and then snap into the recesses of the nest. The nest accordingly lies against the contact surfaces of the pick-up units and on the vertical fixing units. The nest is held by a combination of engagement and a light clamping grip.

Instead of lifting the nest vertically, and in the process lightly spreading the two pick-up units, the nest can also first be hooked into one of the two pick-up units at a slight incline, then pressed lightly against this pick-up unit and finally hooked into the second pick-up unit. When the nest is hooked one side at a time into the two pick-up units, this can have an advantageous effect on the friction and the potential abrasion of particles. The vertical fixing units prevent the nest from tilting.

As soon as the pick-up units have been latched or hooked, the tub can be lowered (for example, in the case of a movable support structure, the nest can be removed by upward movement of the support structure).

The nest can subsequently be gripped, for example, by a robot (positioning unit), which has to "unhook" it from the pick-up units.

For this purpose, the robot moves the nest in the first step slightly in the direction of one of the two pick-up units. This pick-up unit yields as a result of the resilience of the material.

On the side of the opposite, second pick-up unit, the nest is accordingly released, i.e., the nest no longer rests on the support surface or first, horizontally-extending contact surface of the other pick-up unit.

Subsequently, the robot slightly tilts the nest (rotation of the nest about the first, horizontally-extending contact surface of the first pick-up unit), such that the second pick-up unit can no longer latch on. In the last step, the nest is then also unhooked from the first pick-up unit by moving it slightly obliquely downwards in the direction of the second pick-up unit.

As soon as the nest no longer rests on the first pick-up unit, it can also be moved vertically downwards, and no longer has any contact with one of the pick-up units.

If the nest is to be set back into the tub, first, the nest is hooked into both pick-up units (for example, simply by raising the nest), then the tub is positioned under the nest, and finally the nest is unhooked from the pick-up units by means of the tub in the manner described above. Alternatively, the nest can also be hooked in again in a manner analogous to the unhooking (but in the reverse direction).

BRIEF DESCRIPTION OF THE DRAWINGS

Further advantages and advantageous embodiments of the subject matter of the invention are found in the description, the claims, and the drawings.

The above-mentioned features and the features listed further below can be used per se or in any combination thereof. The embodiments shown and described are not to be understood as an exhaustive enumeration, but, rather, have an exemplary character for describing the invention.

Figure 1:
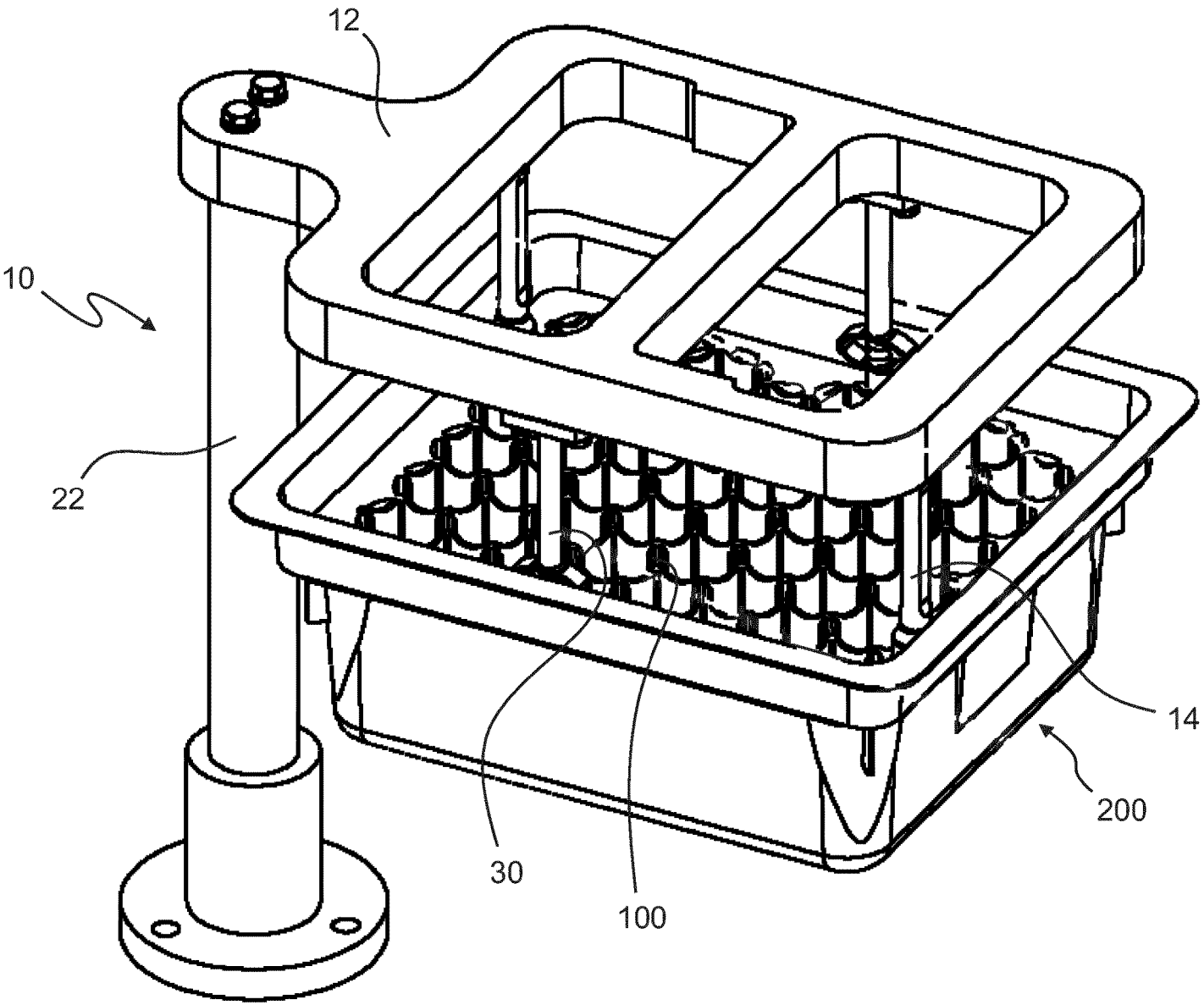
Figure 3:
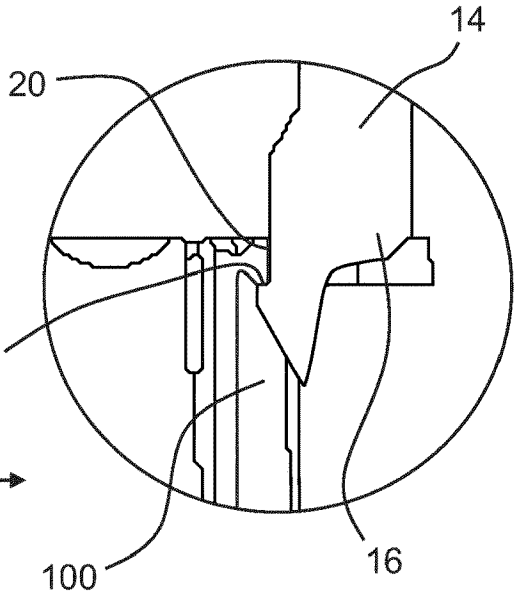
Figure 2:
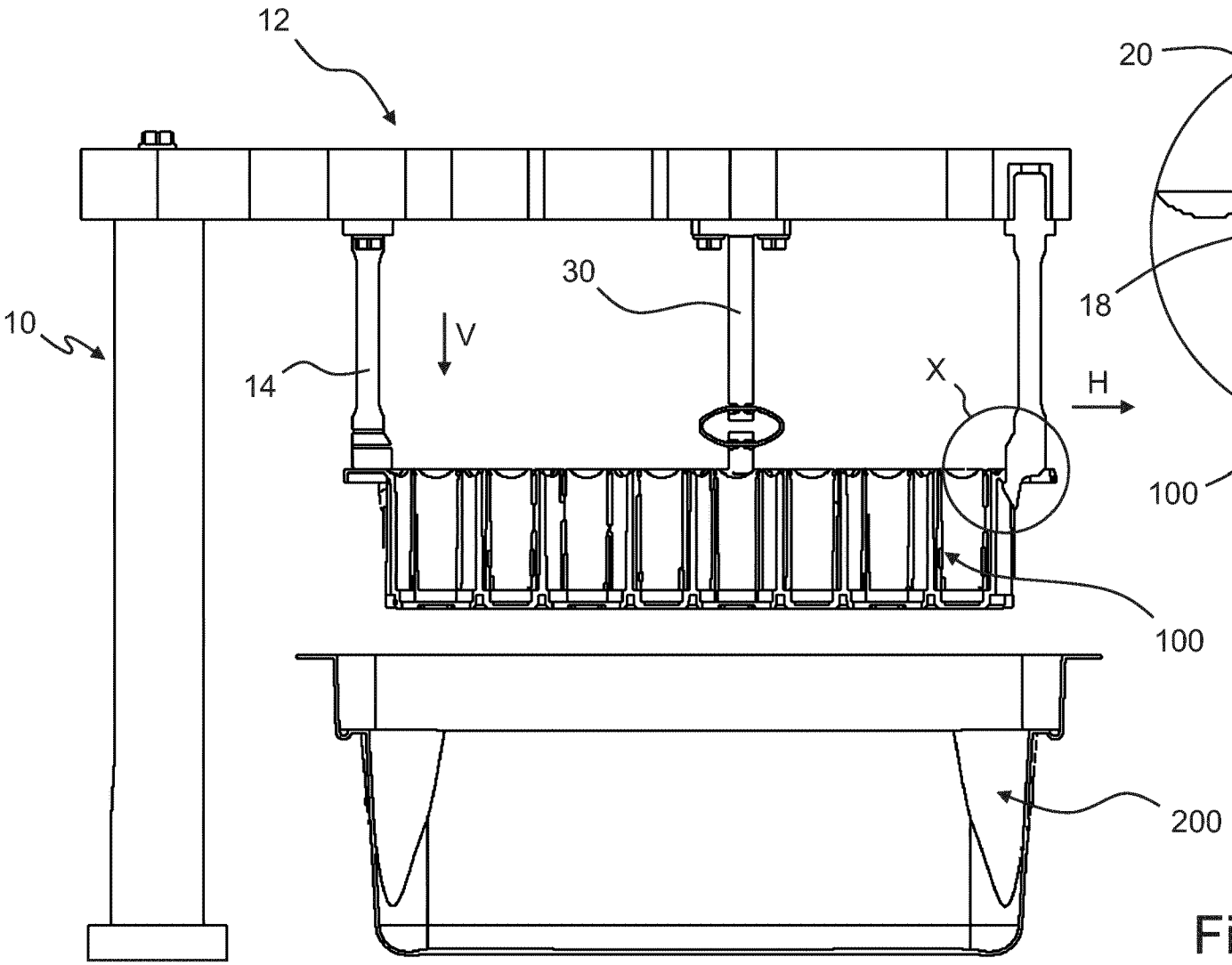
Figure 4:
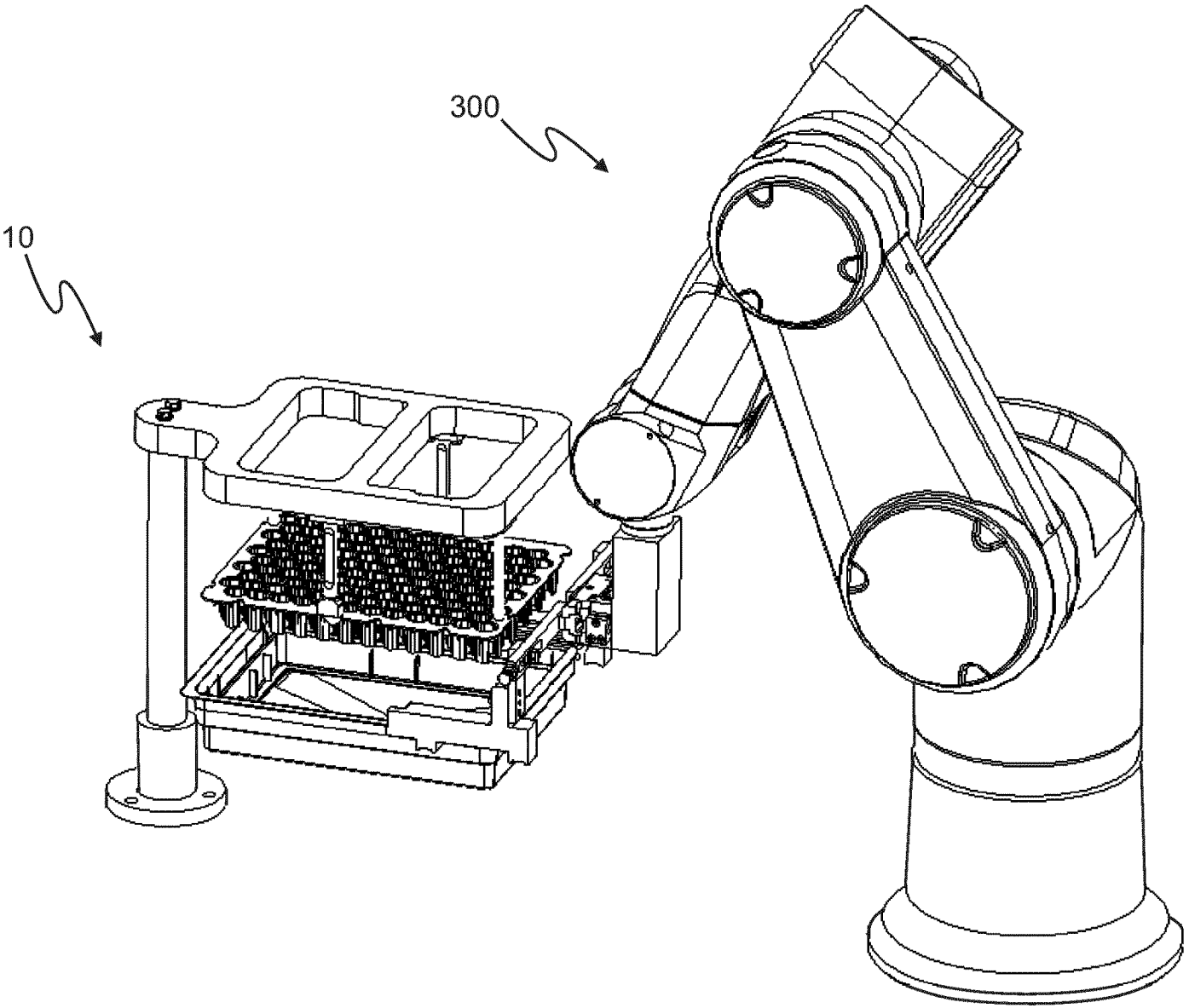
Figure 6:
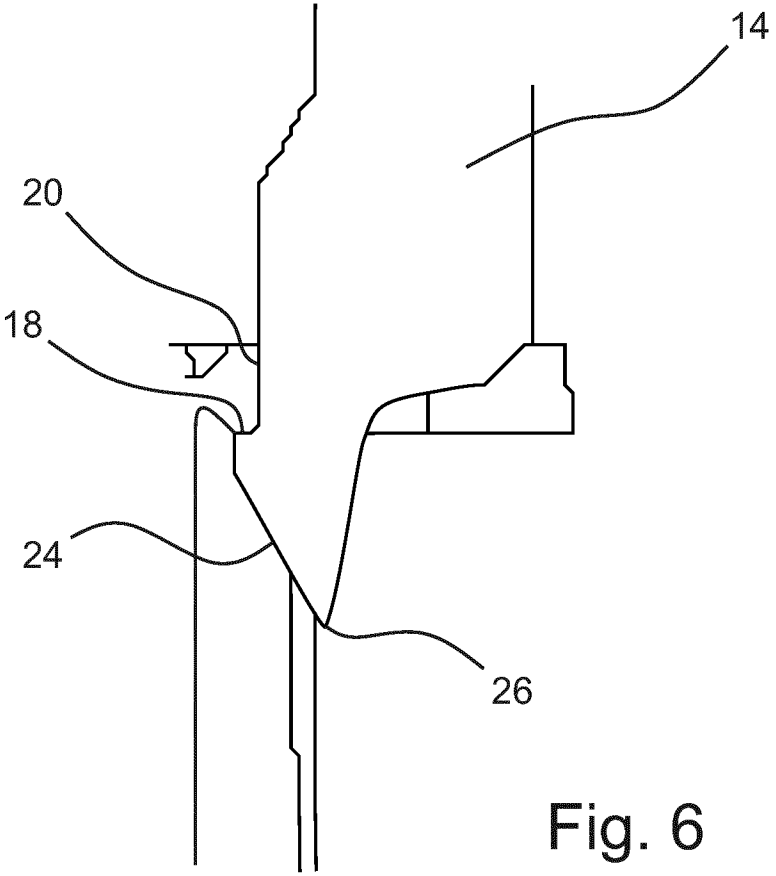
Figure 5:
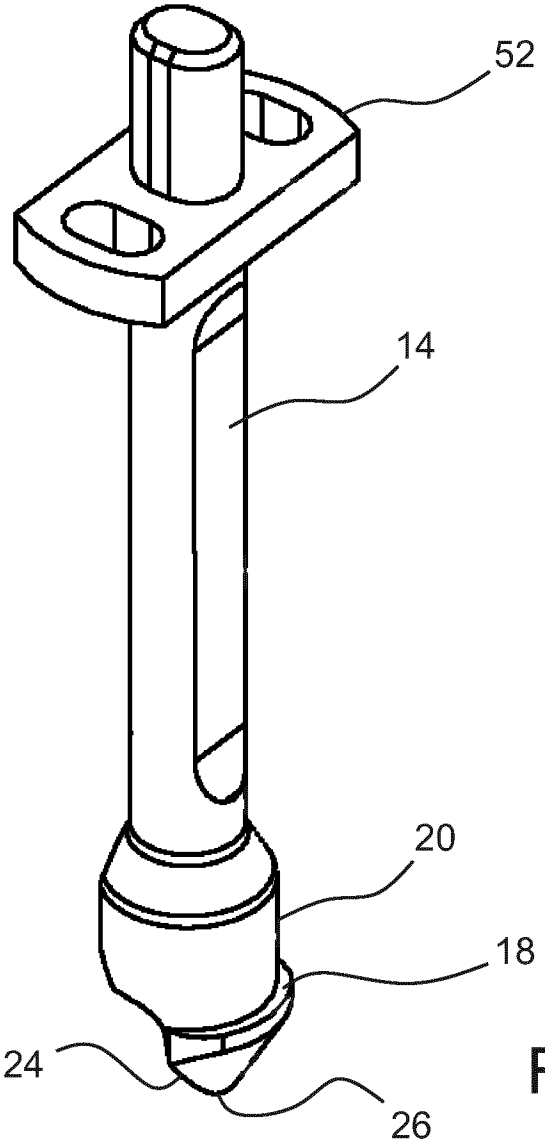
Figure 7:
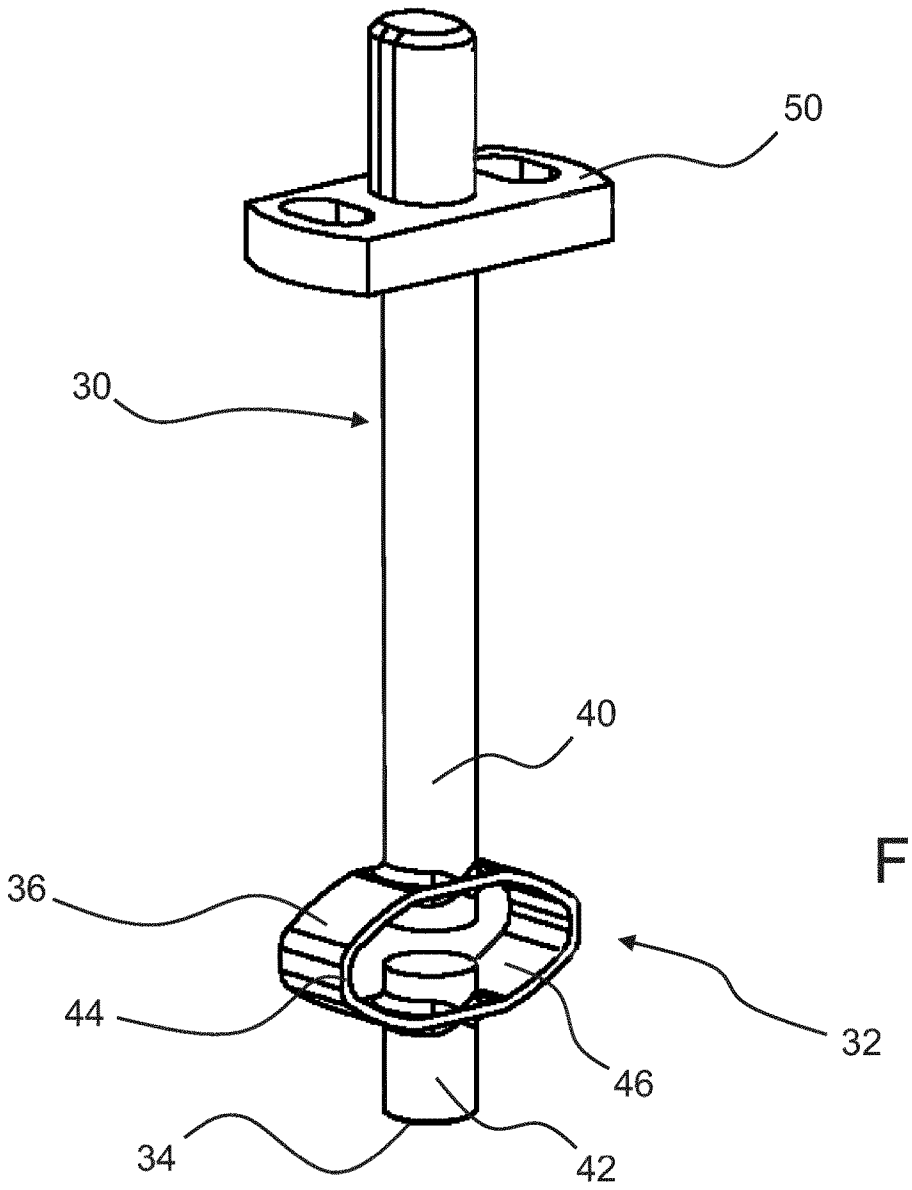

The invention is illustrated in the drawings and is explained in more detail with reference to exemplary embodiments, wherein:

FIG. 1 is an apparatus according to the invention in a perspectival view;

FIG. 2 is a side view of the apparatus from FIG. 1;

FIG. 3 is a subregion of a pick-up unit in engagement with a nest;

FIG. 4 is a further apparatus according to the invention in a perspectival view;

FIG. 5 is a pick-up unit;

FIG. 6 is a lower end of a pick-up unit in a detailed view;

FIG. 7 is a vertical fixing unit; and

Figure 8:
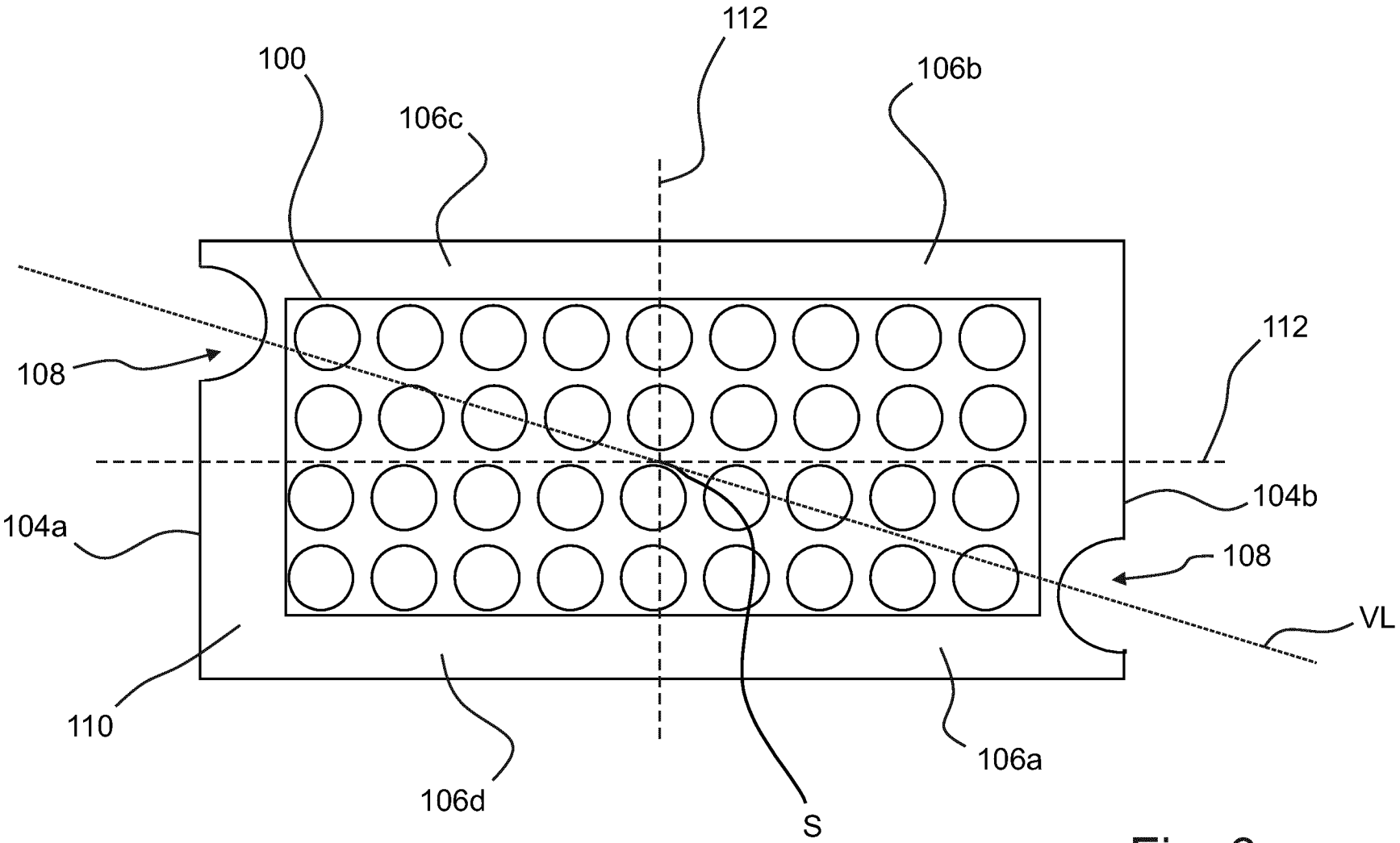

FIG. 8 is a plan view of a schematically illustrated nest.

DETAILED DESCRIPTION

FIG. 1 is an apparatus 10 for removing a nest 100 from a tub 200 without using vacuum.

The apparatus 10 comprises a frame-like support structure 12. The frame-like support structure 12 is held on a stand 22. In the present example, the frame-like support structure 12 is held stationarily on the stand 22. It can also be provided that the support structure 12 be movable. The stand 22 can, for example, be designed to be retractable and extendable. The support structure 12 can be movable up and down.

The apparatus 10 further has two pick-up units 14. The pick-up units 14 are designed like pins. They are elongate in the vertical direction, and their length is a multiple of their extension in the direction orthogonal to the vertical direction.

The pick-up units 14 are designed and arranged such that they extend away from the support structure 12 in the manner of a pin or rod.

The pick-up units 14 are arranged on the support structure 12 in such a way that they can be arranged on opposite sides 104*a*, 104*b* of a nest 100 to be removed and which is substantially rectangular. The arrangement of the nest 100 between the pick-up units 14 allows the nest 100 to be contacted by each of the contact portions 16 of the pick-up units 14.

The respective contact portions 16 have a first, horizontally-extending contact surface 18, and a second, vertically-extending contact surface 20 (see in particular FIGS. 3 and 6).

The first, horizontally-extending contact surface 18 serves to provide a stop in the vertical direction V for the nest 100. The first, horizontally-extending contact surface 18 essentially forms a contact surface on which the nest 100 can rest, or does rest, in the held state.

The second, vertically-extending contact surface 20 serves to provide a stop in the horizontal direction H for the nest 100. The second, vertically-extending contact surface 20 essentially forms a lateral stop which the nest lies against laterally in the held state. Since the second, vertically-extending contact surface 20 is in contact with the nest in several directions in the recesses 108, the nest is fixed in the horizontal direction.

The contact portions 16 are movable away from each other or towards each other.

The pick-up units 14 comprise a resilient material, and/or they consist of a resilient material in the present example.

The pick-up units 14 are flexible in such a way that they can be bent away from each other with little effort. Or, the contact portions 16 can be bent away from each other with little effort. In other words, the contact portion 16 of the one pick-up unit 14 is, by bending the pick-up unit 14, movable away from the contact portion 16 of the other pick-up unit 14, or the contact portions 16 can be spread apart or moved away from each other by bending their respective pick-up units 14.

The contact portions 16 each comprise a centering portion 24. The centering portion 24 in this case comprises an end 26, facing away from the support structure 12, of the pick-up unit 14. The centering portion 24 tapers towards the end 26 of the pick-up unit 14.

The centering portion 24 serves essentially as an insertion aid.

The nest 100 may be part of the apparatus. The nest 100 comprises a peripheral edge 110 projecting in the horizontal direction. In its outer edge 110, the nest 100 comprises recesses 108 which are provided for receiving the pick-up units 14 and/or the centering portions 24 and contact portions 16 thereof.

The apparatus 10 comprises two vertical fixing units 30. More than two vertical fixing units 30 can also be provided. The vertical fixing units 30 are designed to be pin-like. The vertical fixing units 30 each comprise a fixing contact portion 34. The fixing contact portion 34 is designed in each case to contact the nest 100, which is to be gripped and/or removed, from a side opposite the first, horizontally-extending contact surface 18 of the contact portion 16; see in particular FIG. 2.

The vertical fixing unit 30 can be designed to be resilient—in particular, via a spring mechanism 32 which in particular comprises a spring stroke limiter—and capable of being shortened along its extension in the vertical direction.

The vertical fixing unit 30 can be movable relative to the support structure 12. For example, they can be designed to be extendable. In particular, as in the example shown in the figure, the fixing contact portion 34 can be movable in the vertical direction relative to the support structure 12.

The vertical fixing unit 30 comprises two pin-like portions 40, 42, an upper pin-like portion 40 and a lower pin-like portion 42. The portions 40, 42 do not have to be designed in the manner of a pin, but can also be designed, for example, in a block-like or other manner.

The two pin-like portions 40, 42 are connected to each other via a spring mechanism 32. In the present case, the spring mechanism 32 comprises two, laterally-projecting, U-shaped spring elements 44, 46. The two pin-like portions 40, 42 are connected to each other at a distance from each other by the laterally-projecting, U-shaped spring elements 44, 46. Each of the spring elements 44, 46 is connected to the upper pin-like portion 40 and the lower pin-like portion 42 by one of its legs, respectively. In a compression/expansion process, the legs of the U-shape are moved towards or away from each other.

The pin-like portions 40, 42 can be moved towards each other against the preload of the spring connection 36, wherein the vertical fixing unit 30 is shortened in its vertical extension.

The vertical fixing units 30 and the pick-up units 14 are designed to be removable from the support structure 12. For this purpose, the vertical fixing units 30 comprise a flange 50, and each of the pick-up units 14 comprises a flange 52. The vertical fixing units 30 and the pick-up units 14 are attachable to the support structure via the respective flanges 50, 52—for example, via a screw connection.

To remove the nest 100 from the tub 200, the nest 100 (or the tub 200 and the nest 100) located in the tub 200 is moved from below towards the pick-up units 14. In this case, the nest 100 is positioned in advance such that the pick-up units 14 are placed directly above the recesses 108. Upon this lifting, the respective centering portions 24 contact the recesses 108. Since the centering portion 24 widens upwards (or tapers downwards), the pick-up units 14 or their contact portions 16 are pushed apart when the nest is raised further. The nest 100 is raised further until the underside of the edge 110 is at the level of the first, horizontally-extending contact surface 18. The second, vertically-extending contact surface 20 is set back relative to the upper region of the centering portion 24, such that the pick-up units 14 move towards each other due to their inherent tension. The nest 100 rests with the underside of its edge 110 on the first, horizontally-extending contact surface 18, and is gripped laterally by the second, vertically-extending contact surfaces 20 in a clamping manner in the region of the recesses 108. During the upward movement, the upper edge of the nest 100 contacts the vertical fixing units 30 or the fixing contact portions 34 thereof. Upon a further upward movement of the nest 100, the vertical fixing units 30 are shortened against the force of the spring mechanism 32. The two pin-like portions 40, 42 move towards each other, wherein the lower portion 42 rests against the nest 100 from above with a pressure caused by the spring mechanism 32. In the end position, the edge of the nest 100 is then held clamped between the lower portion 42 and the first, horizontally-extending contact surface 18.

The apparatus 10 can comprise a positioning unit 300 which is designed to move the tub 200 with nest 100 located therein towards the pick-up units 14. In FIG. 4, the positioning unit 300 is provided in the form of a robotic arm with multiple degrees of freedom. The positioning unit 300 can move the tub 200 freely in space. Once the nest 100 is held by the pick-up units 14, the positioning unit 300 can remove the tub 200 and then grip the nest 100.

Alternatively or in addition to the resilient design of the pick-up units 14, it can be provided that at least one of the pick-up units 14 be arranged movably on the support structure 12. The pick-up units 14 can, for example, be pivotably attached to the support structure 12; in particular, they can be preloaded into an initial position and can be spread apart by the preload against the preload force.

FIG. 8 schematically shows the nest 100. The rectangular nest 100 has recesses 108 on diagonally-opposite quadrants 106*a*, 106*c*, which recesses are designed to be complementary to the pick-up units 14 and are provided for receiving them. The recesses 108 are each arranged on a narrow side 104 of the rectangular nest 100.

The recesses 108 can also be arranged on the longitudinal sides. As described, they are generally arranged in the diagonally-opposite quadrants, but can also lie exactly centrally on the center lines, for example. In particular, an imaginary connecting line VL (dotted line) of the two recesses (or the pick-up units 14 if they have gripped the nest 100 already) extends through a center of gravity S of the nest. The chance that the nest may tip is reduced as a result. The quadrants 106 *a, b, c, d* are shown separated from each other in FIG. 6 by broken lines 112.

What is claimed is:

1. An apparatus (10) for removing a nest (100) from a tub (200) without using vacuum, wherein the apparatus (10) comprises a support structure (12) and at least two pick-up units (14) extending away from the support structure (12), wherein the pick-up units (14) are arranged on the support structure (12) in such a manner that they can be arranged on opposite sides (104*a*, 104*b*) of a substantially rectangular nest (100) which will be removed, in order to contact, by contact portions (16), the nest (100) and hold the nest by clamping, wherein the respective contact portions (16) have a first, horizontally-extending contact surface (18) for providing a stop in a vertical direction (V) for the nest (100), and a second, vertically-extending contact surface (20) for providing a stop in a horizontal direction (H) for the nest (100), and wherein the apparatus (100) is designed such that the contact portions (16) can be moved away from each other and/or towards each other, wherein at least one of the pick-up units (14) comprises a resilient material, and the contact portion (16) of one of the pick-up units (14) can be moved away from the contact portion (16) of the other pick-up unit (14) as a result of the pick-up unit (14) bending, and wherein the apparatus comprises a vertical fixing unit (30), wherein the vertical fixing unit comprises a fixing contact portion (34) configured to contact the nest from a side opposite the first, horizontally-extending contact surface (18) of the contact portion (16), and wherein the fixing contact portion (34) of the vertical fixing unit (30) is movable in the vertical direction relative to the support structure (12).

2. The apparatus (10) according to claim 1, wherein at least one of the pick-up units (14) comprises a contact portion (16) with a centering portion (24), wherein the centering portion (24) comprises an end (26), facing away from the support structure (12), of the pick-up unit (14), wherein the centering portion (24) tapers towards the end (26) of the pick-up unit (14).

3. The apparatus (10) according to claim 1, wherein at least one of the pick-up units (14) is movably arranged on the support structure (12).

4. The apparatus (10) according to claim 1, wherein the vertical fixing unit (30) is designed to be able to shorten in a resilient manner along its extension in the vertical direction (V).

5. The apparatus (10) according to claim 4, wherein the vertical fixing unit (30) is designed to be able to shorten in a resilient manner along its extension in the vertical direction (V) via a spring mechanism (32) which comprises a spring stroke limiter.

6. The apparatus (10) according to claim 1, wherein the vertical fixing unit (30) and/or the pick-up unit (14) are designed to be removable from the support structure.

7. The apparatus (10) according to claim 1, wherein the apparatus comprises a positioning unit (300) configured to move a nest (100) located in a tub (200) towards the pick-up units (14) so that the nest (100) can be contacted from at least two opposite sides (104), and can be held between the pick-up units (14).

8. The apparatus (10) according to claim 7, wherein the pick-up units (14) are arranged on the support structure (12) in such a manner that the nest (100) can be arranged between the pick-up units (14) in such a way that they contact the rectangular nest (100) on diagonally-opposite quadrants (106*a*, 106*c*).

9. The apparatus (10) according to claim 8, wherein the pick-up units (14) contact the rectangular nest (100) on a narrow side (104) of the rectangular nest (100).

10. The apparatus (10) according to claim 7, wherein the positioning unit (300) is designed to grip and move the tub (200), and the nest (100).

11. The apparatus (10) according to claim 1, wherein the apparatus comprises a nest (100), wherein the pick-up units (14) are arranged on the support structure (12) in such a manner that the nest (100) can be arranged between them.

12. The apparatus (10) according to claim 11, wherein the nest (100) has recesses (108) in its outer edge (110) which are provided for receiving the pick-up units and/or centering portions and contact portions (16) thereof.

13. The apparatus of claim 12 wherein an imaginary connecting line VL of at least two of the recesses (108) extends through a center of gravity(S) of the nest (100).

14. A sterile chamber in which an apparatus (10) according to claim 1 is arranged, in order to remove a nest (100) from a tub (200).

15. The apparatus (10) according to claim 1, wherein the apparatus comprises two vertical fixing units (30).

* * * * *